US005587571A

United States Patent [19]

Perret

[11] Patent Number: 5,587,571

[45] Date of Patent: Dec. 24, 1996

[54] COMBINED-ACTION PUFFER CIRCUIT-BREAKER

[75] Inventor: Michel Perret, Bourgoin-Jallieu, France

[73] Assignee: GEC Alstom T & D SA, Paris, France

[21] Appl. No.: 375,983

[22] Filed: Jan. 20, 1995

[30] Foreign Application Priority Data

Jan. 25, 1994 [FR] France ..... 94 00764

[51] Int. Cl.[6] ..... H01H 33/82

[52] U.S. Cl. ..... 218/60

[58] Field of Search ..... 218/43, 51–53, 218/57, 59–64, 66, 68, 72, 78, 84, 86, 88, 154

[56] References Cited

U.S. PATENT DOCUMENTS

| | | | |
|---|---|---|---|
| 4,103,131 | 7/1978 | Graf et al. | 200/148 A |
| 4,458,120 | 7/1984 | Körner et al. | 200/148 A |
| 5,293,014 | 3/1994 | Perret | 200/148 A |

FOREIGN PATENT DOCUMENTS

| | | | |
|---|---|---|---|
| 0540971A1 | 5/1993 | European Pat. Off. | H01H 33/91 |
| 2354625 | 1/1978 | France | H01H 33/91 |
| 3127678A1 | 2/1983 | Germany | H01H 33/915 |
| 3942489A1 | 6/1991 | Germany | H01H 33/915 |
| 667943A5 | 11/1988 | Switzerland | H01H 33/88 |

OTHER PUBLICATIONS

French Search Report FR 9400764.

*Primary Examiner*—Patrick J. Stanzione
*Assistant Examiner*—Michael A. Friedhofer
*Attorney, Agent, or Firm*—Sughrue, Mion, Zinn, Macpeak & Seas

[57] ABSTRACT

The present invention relates to a circuit-breaker including, inside a casing filled with a dielectric gas, a first arcing contact connected to a first terminal, and a second arcing contact having the same longitudinal axis as the first contact. The second arcing contact is connected to a second terminal, is mounted to move axially in a fixed cylinder, and co-operates with a moving piston to form a compression chamber. The circuit-breaker further includes a mechanism for driving the piston in a direction that is opposite to the direction in which the second contact is displaced. The driving mechanism acts during a first portion of the displacement of the moving contact from the closed position to the open position the circuit-breaker also includes a mechanism for constraining the piston to move with the moving contact during a second portion of the same displacement of the moving contact.

4 Claims, 3 Drawing Sheets

COMBINED-ACTION PUFFER CIRCUIT-BREAKER

The present invention relates to a combined-action puffer circuit-breaker.

BACKGROUND OF THE INVENTION

Document FR-2 683 383 discloses a circuit-breaker including, inside a casing filled with a dielectric gas, in particular $S_6$, a first arcing contact connected to a first terminal, and a second arcing contact having the same longitudinal axis as the first contact, which second arcing contact is connected to a second terminal, is mounted to move in a fixed cylinder, and co-operates with a moving piston to form a compression chamber, the circuit-breaker further including drive means for driving the piston in a direction that is opposite to the direction in which the second contact is displaced.

During opening, the gas in the compression chamber is compressed because the distance between the piston and the annular wall separating the compression chamber from the blast chamber decreases. In that known circuit-breaker, the dielectric gas is compressed during the entire displacement of the moving contact assembly between the closed position and the open position. A certain quantity of energy is required to displace the moving contact assembly. The required quantity of energy is particularly large since the gas in the compression chamber is compressed during the entire travel of the moving contact assembly.

OBJECTS AND SUMMARY OF THE INVENTION

An object of the invention is to reduce the energy consumption of the circuit-breaker during opening, and also to have the highest possible pressure in the expansion volume (connected to the compression volume) on arcing contact separation.

To this end the invention provides that the drive means act during a first portion of the displacement of the second arcing contact, which is a moving contact, from the closed position to the open position, and the circuit-breaker includes means for constraining the piston to move with the moving contact during a second portion of the same displacement of the moving contact.

In a preferred embodiment, the drive means are constituted by at least two links, each of which has one end hinged to a guide element, the other end of the first link being hinged to the piston, and the other end of the second link being hinged to the moving contact, the guide element being mounted to move freely along a first groove that is perpendicular to the longitudinal axis of the second contact, and that is provided in a fixed portion, the two links being disposed one on either side of a vertical plane containing the longitudinal axis of the first groove.

The means for constraining the piston to move with the moving contact are constituted by said links and by said guide element mounted to move along at least one second groove that is parallel to the longitudinal axis of the second contact, and that is connected to the first groove.

Advantageously, said fixed portion is the fixed cylinder.

BRIEF DESCRIPTION OF THE DRAWINGS

The invention is described below in more detail with reference to the accompanying drawings which merely show a preferred embodiment of the invention.

in FIG. 1, the circuit-breaker is in the closed position;

in FIG. 2, the circuit-breaker is in the contact-separation position;

in FIG. 3, the circuit-breaker is in the end-of-compression position; and in FIG. 4, the circuit-breaker is in the open position.

MORE DETAILED DESCRIPTION

Figure 1:
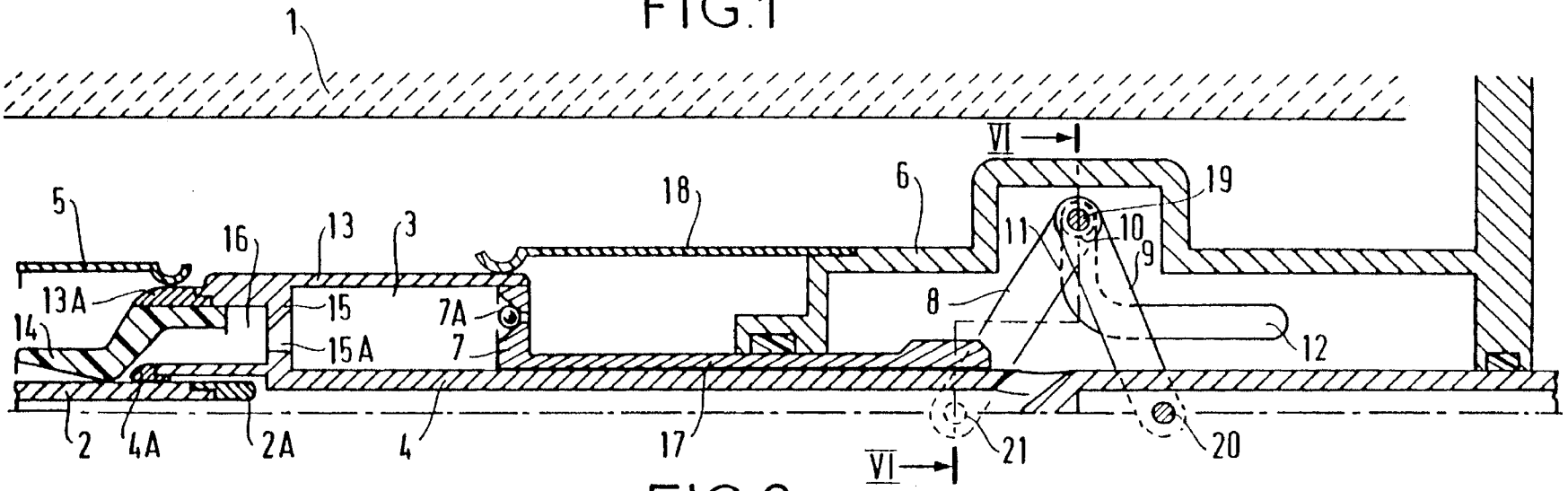
FIGS. 1 to 4 are longitudinal section views of a circuit-breaker of the invention, where.

A single interrupting chamber having a horizontal longitudinal axis is described below, but it is to be understood that a high-voltage circuit-breaker may include a plurality of such interrupting chambers for each phase, which chambers may have longitudinal axes that are vertical or horizontal. In the figures, the same references designate identical elements.

In the figures, reference 1 designates an insulating casing, e.g. made of porcelain, or metal in the case of a metal-clad circuit,breaker, filled with a gas having good dielectric properties, e.g. sulfur hexafluoride, under a pressure of a few bars.

The circuit-breaker includes a fixed assembly and a moving contact assembly.

The fixed assembly includes a first arcing contact 2 constituted by a metal tube whose end 2A is made of a material that withstands arcing effects, e.g. an alloy based on tungsten. The fixed assembly further includes a fixed permanent contact 5 constituted by fingers. The arcing contact and the fixed permanent contact are electrically connected to a first terminal (not shown).

The moving contact assembly includes a drive part passing through the interrupting chamber in gastight manner and connected to a mechanism that is not shown. The drive part or rod is connected to a metal assembly comprising two coaxial tubes 4 and 13, tube 13 having a larger diameter than tube 4. The two tubes 4 and 13 are interconnected via a metal annular wall 15. The tubes and the annular wall are preferably machined as a single piece.

Tube 4 constitutes a second arcing contact which is the moving arcing contact and it is actuated axially by the drive rod in known manner. Its end 4A co-operates with contact 2, and is made of a material that withstands arcing effects. Tube 13 has a small-diameter end 13A carrying a blast nozzle 14 made of an insulating material. The tubular portion 13A constitutes the permanent moving contact of the circuit-breaker and, when the circuit-breaker is the closed position, said tubular portion co-operates with the fingers 5 as shown in FIG. 1.

The end 13A of the tube 13, the blast nozzle 14, tube 4 and the annular wall 15 define a blast and expansion chamber 16. The annular wall 15, the tubes 4 and 13, and a piston 7 define a compression chamber 3 separated from the blast chamber 16 by the annular wall 15. The piston 7 is slidably mounted to slide axially between the tubes 4 and 13 in gastight manner. The piston 7 includes a tube 17 that is coaxial with tubes 4 and 13 and that is mounted to slide on tube 4 inside a fixed cylinder 6 that is coaxial with the other tubes. The cylinder 6 is electrically connected to a second terminal (not shown). The cylinder 6 also supports a permanent contact formed of fingers 18 in electrical contact with the tube 13.

The piston 7 is provided with a non-return valve 7A enabling gas to flow from inside the interrupting chamber to the compression chamber 3. Annular wall 15 is provided merely with an orifice 15A.

The circuit-breaker includes firstly drive means for driving the piston 7 in a direction that is opposite to the direction in which the moving arcing contact 4 is displaced, which drive means act during a first portion of the displacement of the moving arcing contact 4 from the closed position to the open position, and secondly means for constraining the piston 7 to move with the moving contact during a second portion of the same displacement of the moving arcing contact 4.

The drive means are constituted by at least two links 8, 9, each of which has one end hinged to a guide element 10. The other end of the first link 8 is hinged to the tube 17 of the piston 7, and the other end of the second link 9 is hinged to the moving arcing contact 4. The guide element 10 is mounted to move freely along at least one first groove 11 that is perpendicular to the longitudinal axis of the moving arcing contact 4, which groove is vertical in the embodiment shown. The groove is provided in a fixed portion 6A that is part of the fixed portion of the fixed cylinder (of the circuit-breaker) 6, and the two links 8 and 9 are disposed one on either side of a vertical plane containing the longitudinal axis of the first groove 11.

The means for constraining the piston to move with the moving contact are constituted by said links 8 and 9 and by said guide element 10 mounted to move along at least one second groove 12 that is parallel to the longitudinal axis of the moving arcing contact (i.e. horizontal in the embodiment shown), and that is connected to the first groove 11.

Figure 5:
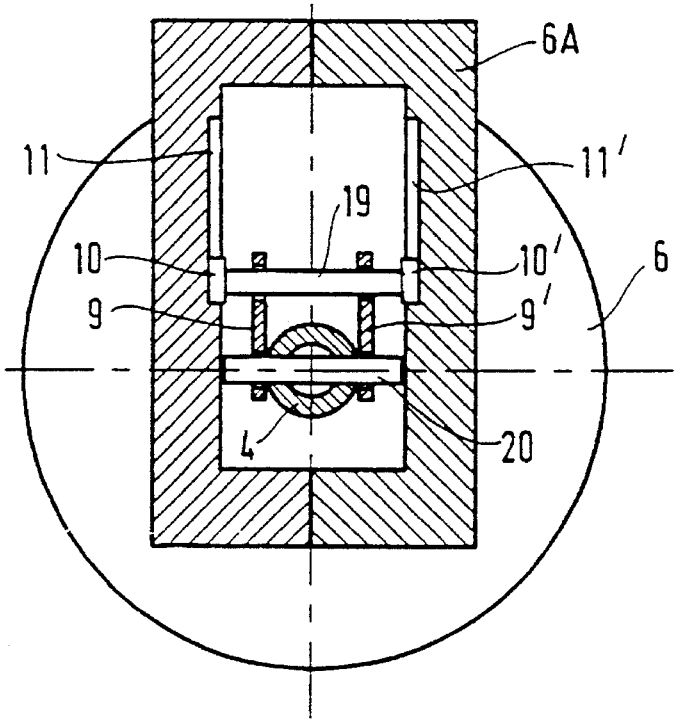
FIG. 5 is a section view on V—V of FIG. 4.
Figure 6:
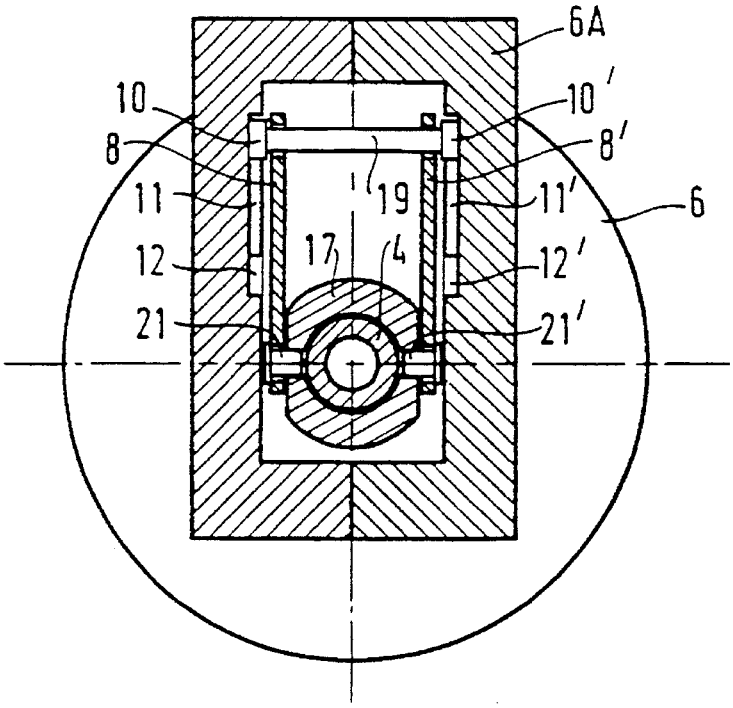
FIG. 6 is a section view on VI—VI of FIG. 1.

These means are shown in more detail in FIGS. 5 and 6.

Two L-shaped grooves 11–12 and 11'–12' are formed in opposite facing faces of the fixed portion 6A constituting a portion of the cylinder 6. A pin 19 is engaged in the two grooves via two wheels 10 and 10'. 0n one side of a vertical plane containing the longitudinal axis of the pin 19, the pin supports two links 9 and 9', and on the other side of said vertical plane, the pin supports two other links 8 and 8'.

As shown in FIG. 5, links 9 and 9' are pivotally mounted via their other ends on another pin 20 passing through the tube 4 constituting the moving arcing contact.

As shown in FIG. 6, links 8 and 8' are pivotally mounted via their other ends on studs 21 and 21' connected to the tube 17 of the piston 7.

The circuit-breaker operates as described below with reference to FIGS. 1 to 4.

In FIG. 1, the circuit-breaker is shown in the closed position. The moving arcing contact 4 is pushed by the drive rod to its left end position. The wheels 10 and 10' are in their high end positions in the vertical grooves 11, 11' (when the overall position of the circuit-breaker is horizontal), and, in this position, the piston 7 is in its position furthest from the annular wall 15, with the volume of the compression chamber 3 being at its maximum.

Figure 2:
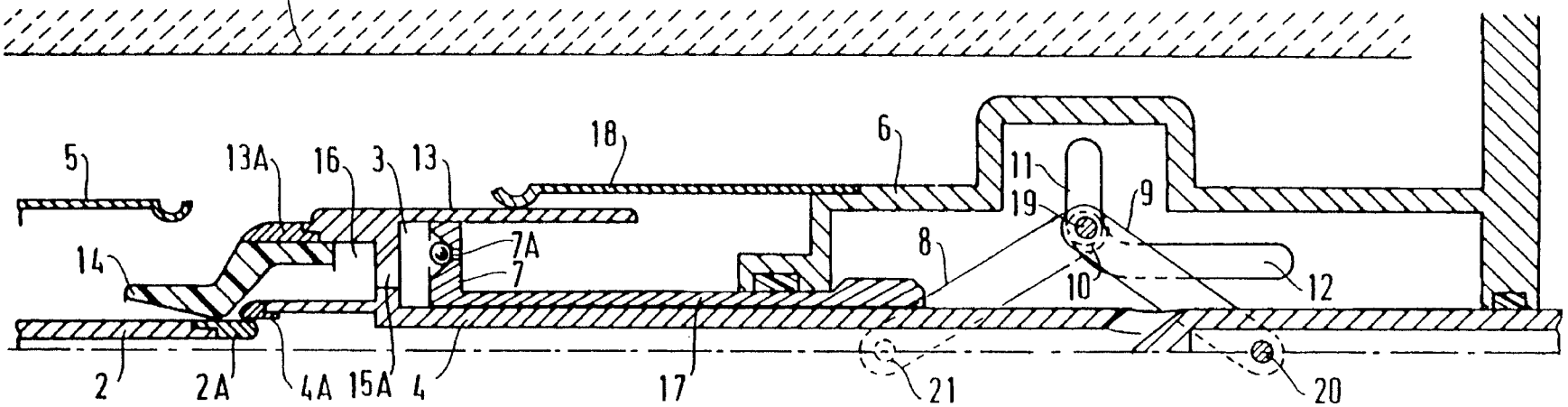

On opening, as shown in FIG. 2, the rod pulls the moving contact 4 rightwards and the contacts 2A and 4A separate. Since contact 4 is displaced, pin 20 is also displaced, and links 9 and 9' pull wheels 10 and 10' downwards, thereby also displacing links 8 and 8' which push the studs 21 and 21', and therefore the tube 17 of the piston 7 leftwards. The gas in the compression chamber 3 is therefore compressed by the combined displacements of the piston 7 and of the annular wall 15, and the compressed gas fills the blast chamber 16.

This combined action is particularly advantageous for obtaining a high blasting pressure and for avoiding re-arcing in circuit-breakers having low pressures of dielectric gas, e.g. in networks operating at temperatures that can be very low.

Figure 3:
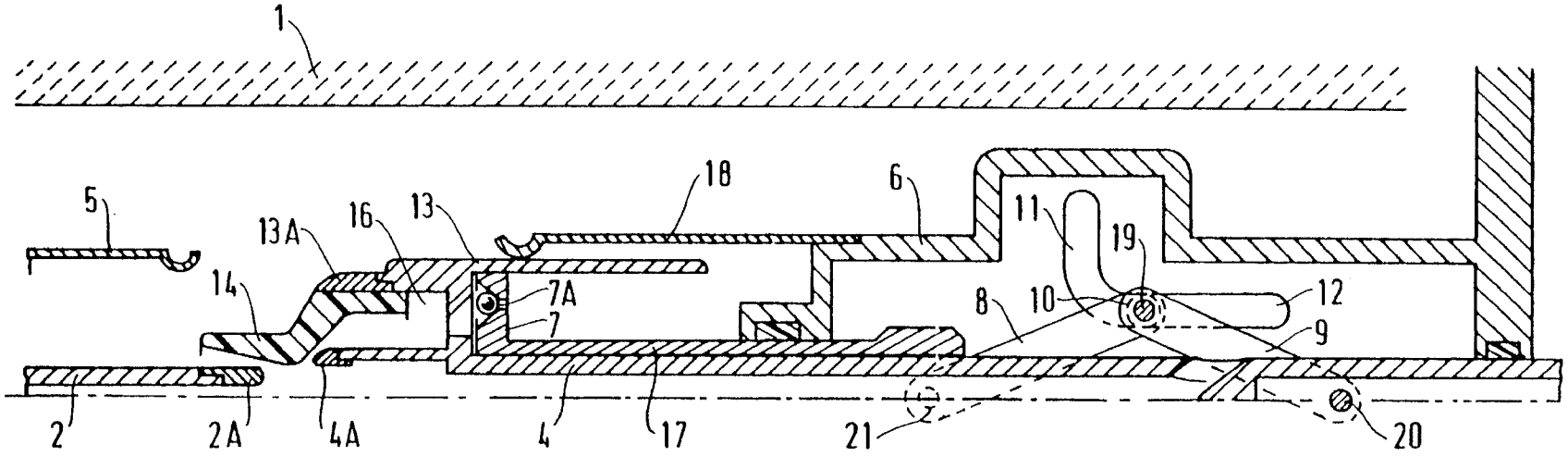

Once the contacts have been separated, as shown in FIG. 3, the arc strikes and gives rise to a large increase in pressure in the blast and expansion chamber 16 in which the pressure is already high, and, in this way, the arc is easily blasted. The wheels 10 and 10' have then reached their lowest positions at the entrance to the horizontal groove 12. Preferably, the dimensions are chosen so that, at that time, the piston 7 abuts against the annular wall 15, and the volume of the compression chamber 3 is substantially zero. Optionally the compression chamber 3 may be given a "dead" volume that is not zero by choosing different dimensions.

Figure 4:
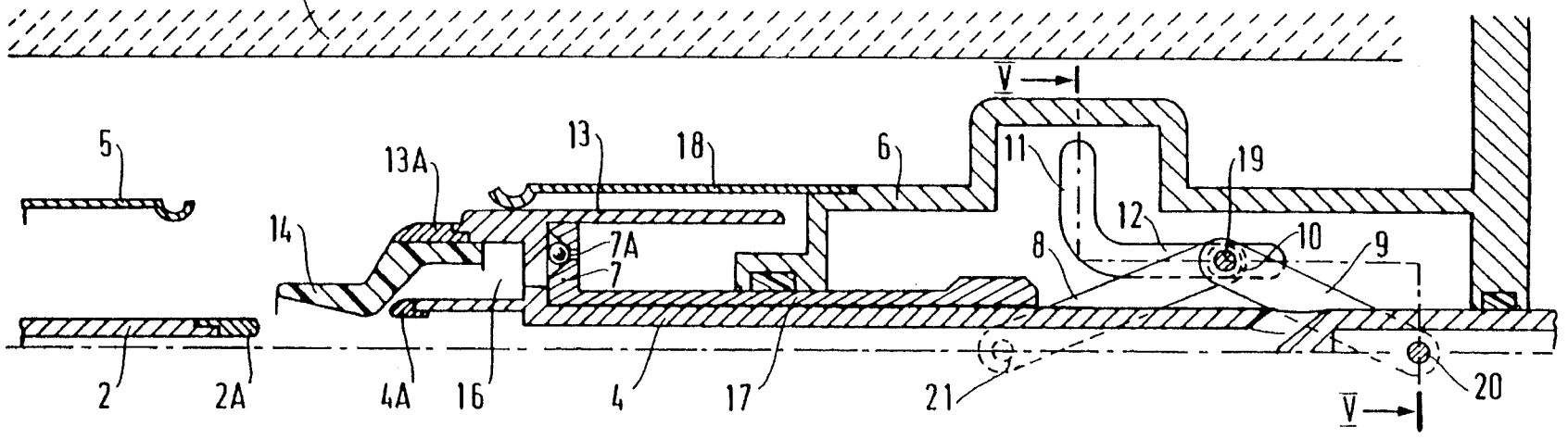

Since the displacement of contact 4 is continuous, the entire moving assembly is then displaced, with the piston 7 being constrained to move with the contact 4 by the linkage 8, 8', 9, and 9', the wheels 10 and 10' being displaced along the horizontal groove 12 to the open position as shown in FIG. 4.

By means of the linkage, the piston 7 and the contact 4 have the same displacement speed, and it is therefore unnecessary to provide a non-return valve member in the orifice 15A in the annular wall 15.

The circuit-breaker is re-closed by the same displacements in the opposite directions.

I claim:

1. A circuit-breaker comprising, a casing filled with a dielectric gas;

a first arcing contact disposed within said casing connected to a first terminal;

a second arcing contact disposed within said casing having the same longitudinal axis as the first contact, said second arcing contact being a moving arcing contact, said moving arcing contact being connected to a second terminal and being mounted to moving axially in a fixed cylinder, said moving arcing contact cooperating with one and only one piston, said one and only one piston being a moving piston to form a compression chamber;

drive means for driving the moving piston in a first direction opposite to a second direction in which the moving arcing contact is displaced, wherein the drive means acts during a first portion of a displacement of the moving arcing contact from a closed position to an open position; and means for constraining the moving piston to move with the moving arcing contact during a second portion of the displacement of the moving contact.

2. A circuit-breaker according to claim 1, wherein the drive means comprises at least a first link and a second link, the first link and said second link each having a first end hinged to a guide element, a second end of the first link being hinged to the moving piston, and a second end of the second link being hinged to the moving arcing contact, the guide element being mounted to move freely along a first groove, the first groove being perpendicular to the longitudinal axis of the second contact, and being provided in a fixed portion of the circuit-breaker, the first link and the second link being disposed one on either side of a vertical plane containing the longitudinal axis of the first groove.

3. A circuit-breaker according to claim 2, wherein the means for constraining the moving piston to move with the moving arcing contact comprises said first link and said second link and said guide element mounted to move along at least one second groove being parallel to the longitudinal axis of the moving arcing contact, and being connected to the first groove.

4. A circuit-breaker according to claim 2, wherein said fixed portion is part of the fixed cylinder of the circuit-breaker.

* * * * *